US008327620B2

(12) United States Patent
Van Nieuwstadt et al.

(10) Patent No.: US 8,327,620 B2
(45) Date of Patent: Dec. 11, 2012

(54) $NO_x$ SENSOR COMPENSATION

(75) Inventors: Michiel J. Van Nieuwstadt, Ann Arbor, MI (US); Dave Charles Weber, Toledo, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 536 days.

(21) Appl. No.: 12/512,870

(22) Filed: Jul. 30, 2009

(65) Prior Publication Data

US 2011/0023459 A1 Feb. 3, 2011

(51) Int. Cl.
*F01N 3/00* (2006.01)

(52) U.S. Cl. ..... 60/285; 60/274; 60/276

(58) Field of Classification Search ..... 60/274, 60/276, 285, 277

See application file for complete search history.

(56) References Cited

U.S. PATENT DOCUMENTS 6,228,252 B1 5/2001 Miyata et al.
6,311,480 B1 * 11/2001 Suzuki et al. ..... 60/276

* cited by examiner

*Primary Examiner* — Thomas Denion
*Assistant Examiner* — Diem Tran
(74) *Attorney, Agent, or Firm* — Julia Voutyras; Alleman Hall McCoy Russell & Tuttle LLP

(57) ABSTRACT

Various systems and methods are described for controlling an engine in a vehicle during engine operation, the engine having an exhaust and a $NO_x$ sensor coupled in the engine exhaust. One example includes correcting the NOx sensor to account for transients in exhaust gas flow, such as transients in exhaust gas flow rate. Such transients may cause NOx sensor temperature to deviate from a desired value as the sensor heater is unable to maintain temperature during such transients. In this way, even during such transients, accurate NOx readings are still available.

17 Claims, 3 Drawing Sheets

$NO_x$ SENSOR COMPENSATION

TECHNICAL FIELD

The present application relates to a gas sensor for measuring emissions from motor vehicles, and more particularly, for measuring nitrogen oxide ($NO_x$) emissions from motor vehicles.

BACKGROUND AND SUMMARY

A variety of emissions, such as nitrogen oxides (e.g., NO and $NO_2$), are emitted in exhaust gases of internal combustion engines. In order to decrease emissions from motor vehicles, emissions are regulated via use of exhaust system components, such as catalytic converters. Additionally, various gas sensors, including $NO_x$ sensors, are employed to detect the emissions in exhaust gases.

During operation, accurate measurement of $NO_x$ in the exhaust gases may depend on temperature control of a NOx sensor. U.S. Pat. No. 6,228,252 describes a method to correct $NO_x$ concentration measurement of a $NO_x$ sensor via temperature detection of the sensor. In the cited reference, temperature detection of the $NO_x$ sensor is implemented by measuring internal resistance of a gas concentration measurement cell, as internal resistance is temperature dependent. Depending on a measured offset of the $NO_x$ sensor temperature from a target temperature, the $NO_x$ concentration measurement may be adjusted. An offset from the target temperature of the sensor may occur, for example, due to a sudden change in the temperature of the exhaust gases or due to a sudden change in the flow rate of the exhaust gases. Thus, temperature of a NOx sensor may be detected and, in the event of an offset, the $NO_x$ measurement may be corrected without additional temperature sensing components.

However, measuring the internal temperature of the $NO_x$ sensor by measuring internal resistance of the gas concentration measurement cell requires a temporary cessation of measuring the $NO_x$ concentration. Specifically, the approach relies on applying a constant voltage to the terminals of the measurement cell or applying a constant current through the measurement cell for calculating the resistance, and thus the temperature, of the measurement cell. The $NO_x$ concentration is measured by detecting a current through the measurement cell that changes proportionally to the concentration of $NO_x$. Given the different requirements for measuring temperature and for measuring $NO_x$ concentration, these measurements may be time-multiplexed and there may be times when the $NO_x$ sensor is not measuring the $NO_x$ concentration or not measuring sensor temperature. Furthermore, even if the temperature could somehow be measured and used during the transient condition, errors in the transient NOx readings may still be generated, for example due to slow responsiveness of temperature readings, system effects, temperatures differences between the cells, etc, for example. In other words, even with this described temperature correction, erroneous NOx readings during transient conditions may still be generated.

The inventors herein have recognized the above problems and have devised an approach to address them. Thus, in one example, a method which includes adjusting the NOx concentration based on transient engine exhaust conditions is disclosed. Various transient engine exhaust conditions may be considered, such as changes in exhaust gas flow rate, changes in exhaust gas temperature, and/or changes in exhaust gas $O_2$ concentration. Further, the method may consider the rate of change of such parameters, or other such indicative values.

In one specific example, the method may include generating a correction value for a $NO_x$ concentration reading from the $NO_x$ sensor based on rate of change of exhaust gas flow rate, and correcting the $NO_x$ concentration reading using the correction value. In this manner, it is possible to more continuously monitor the NOx concentration during transient engine conditions Further, note that in addition to the corrections based on the transient exhaust flow conditions, various additional corrections may also be used, such as based on $NO_x$ sensor temperature, exhaust temperature, etc.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
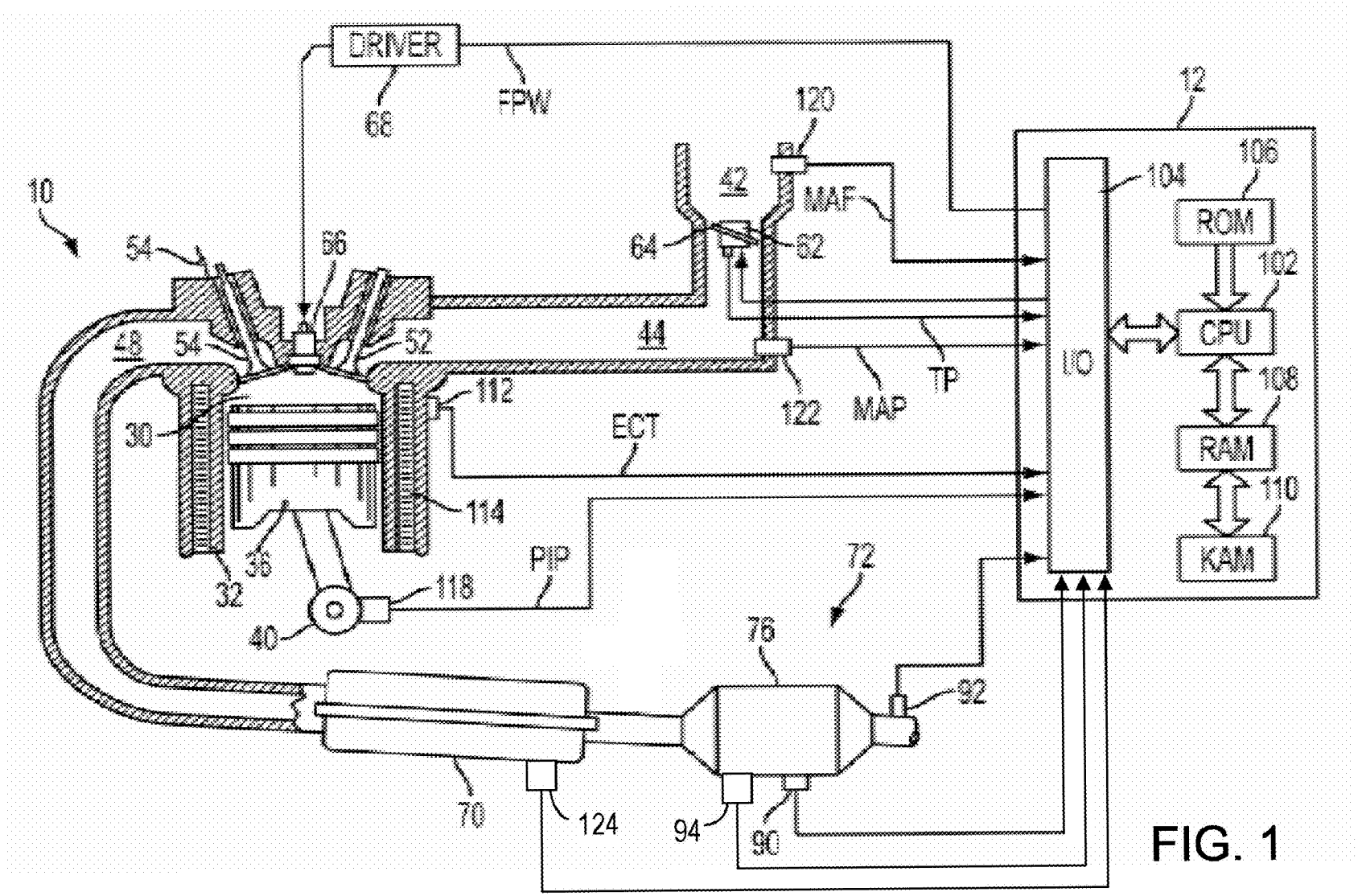
FIG. 1 shows a schematic diagram of an example cylinder of an internal combustion engine including an exhaust system, the exhaust system including a catalyst and a NOx sensor.

Various examples of the approaches described herein may be understood with respect to an example engine and exhaust system including a catalyst and a $NO_x$ sensor, such as that described in FIG. 1. An example $NO_x$ sensor is described in FIG. 2. The NOx concentration reported by the NOx sensor is dependent upon the NOx sensor temperature which may vary as the engine cycles through various transient conditions. Therefore, the reading from the NOx sensor may be corrected in real-time based on the engine conditions. Furthermore, the engine and the NOx sensor heater may be adjusted based on engine operating conditions as described in the high level flow-chart of FIG. 3.

FIG. 1 shows an example internal combustion engine 10 comprising a plurality of combustion chambers, only one of which is shown. The engine 10 may be controlled by electronic engine controller 12. In one example, engine 10 may be a common rail direct injection diesel engine.

Combustion chamber 30 of engine 10 includes combustion chamber walls 32 with piston 36 positioned therein and connected to crankshaft 40. Combustion chamber 30 is shown communicating with intake manifold 44 and exhaust manifold 48 via intake valve 52 and exhaust valve 54. While this example shows a single intake and exhaust valve, one or more cylinders may include a plurality of intake and/or exhaust valves.

Fuel injector 66 is shown directly coupled to combustion chamber 30 for delivering liquid fuel directly therein in proportion to the pulse width of signal FPW received from controller 12 via electronic driver 68. Fuel may be delivered by a fuel system (not shown) including a fuel tank, fuel pumps, and a common fuel rail (not shown). In some embodiments, engine 10 may include a plurality of combustion chambers each having a plurality of intake and/or exhaust valves.

Intake manifold 44 may include a throttle body 42 and may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake manifold 42 may also include a mass air flow sensor 120 and a manifold air pressure sensor 122 for providing respective signals MAF and MAP to controller 12.

Catalytic converter 70 is shown in communication with exhaust manifold 48. In some embodiments, catalytic converter 70 may be a lean $NO_x$ trap (LNT) which may include various precious metals, such as rhodium (Rh). In an alternative embodiment, catalytic converter 70 may employ selective catalytic reduction (SCR). In this particular example, the temperature of catalytic converter 70 is provided by temperature sensor 124. In an alternate embodiment, the temperature of catalytic converter 70 may be inferred from engine operation. An emission control system 72 is shown downstream of catalytic converter 70. Emission control system 72 may include emission control device 76, which in one example may be a diesel particulate filter (DPF). The DPF may operate actively or passively, and the filtering medium can be of various types of material and geometric construction. One example construction includes a wall-flow ceramic monolith comprising alternating channels that are plugged at opposite ends, thus forcing the exhaust flow through the common wall of the adjacent channels whereupon the particulate matter is deposited.

While this example shows catalytic converter 70 upstream of a DPF, the DPF may also be positioned upstream of catalytic converter 70.

Although catalytic converter 70 and DPF are normally viewed as separate entities, it is possible to combine the two on one substrate, e.g., a wall-flow ceramic DPF element coated with $NO_x$ storage agents and platinum group metals.

To provide more accurate control of engine operation and/or exhaust air-fuel ratio, one or more exhaust sensors may be used in the exhaust system, such as indicated at 90, 92, and 94. Further, various additional exhaust sensors may also be used in emission control system 72, such as various $NO_x$ sensors, ammonia sensors, etc., denoted at 92. Additional properties of exhaust gases may be measured by various additional sensors such as temperature sensors, mass air flow sensors, etc., denoted at 94. In an alternate embodiment, exhaust temperature and air flow may be inferred from engine operation.

In one example, sensor 92 communicated with controller 12 as illustrated in FIG. 1. However, a control system may include a plurality of controllers, such as controller 12, where the controllers may be networked together, or otherwise communicate with each other. For example, sensor 92 may include a microprocessor for carrying out one or more operations corrected readings of the NOx sensor for various factors, such as temperature, which are then communicated to controller 12 and further corrected to account for still other factors, such as change in exhaust gas flow rate, exhaust gas temperature, or others as described herein.

System 72 may also include a reductant injector, such as a fuel injector, located in the engine exhaust (not shown). Further, the system may include a reformer to process fuel into $H_2$, CO, cracked and partially oxidized HCs for injection into the exhaust thereby enabling improved reduction performance. Still other methods of reductant delivery to the exhaust, such as rich combustion, may also be used.

Controller 12 is shown in FIG. 1 as a microcomputer including: microprocessor unit 102, input/output ports 104, an electronic storage medium of executing programs and calibration values, shown as read-only memory (ROM) chip 106 in this particular example, random access memory (RAM) 108, keep alive memory (KAM) 110, and a data bus (I/O). Controller 12 may include instructions, such as code, stored on computer readable medium that can be executed by the controller. Controller 12 is also shown receiving various signals from sensors coupled to engine 10, in addition to those signals previously discussed, including: engine coolant temperature (ECT) from temperature sensor 112 coupled to cooling sleeve 114; a profile ignition pickup signal (PIP) from Hall effect sensor 118 coupled to crankshaft 40 giving an indication of engine speed (RPM); throttle position TP from throttle position sensor 120; and absolute Manifold Pressure Signal MAP from sensor 122.

Combustion in engine 10 can be of various types, depending on operating conditions. While FIG. 1 depicts a compression ignition engine, it will be appreciated that the embodiments described herein may be used in any suitable engine, including but not limited to, diesel and gasoline compression ignition engines, spark ignition engines, direct or port injection engines, etc. Further, various fuels and/or fuel mixtures such as diesel, bio-diesel, gasoline, ethanol, compressed natural gas (CNG), $H_2$, etc. may be used.

Figure 2:
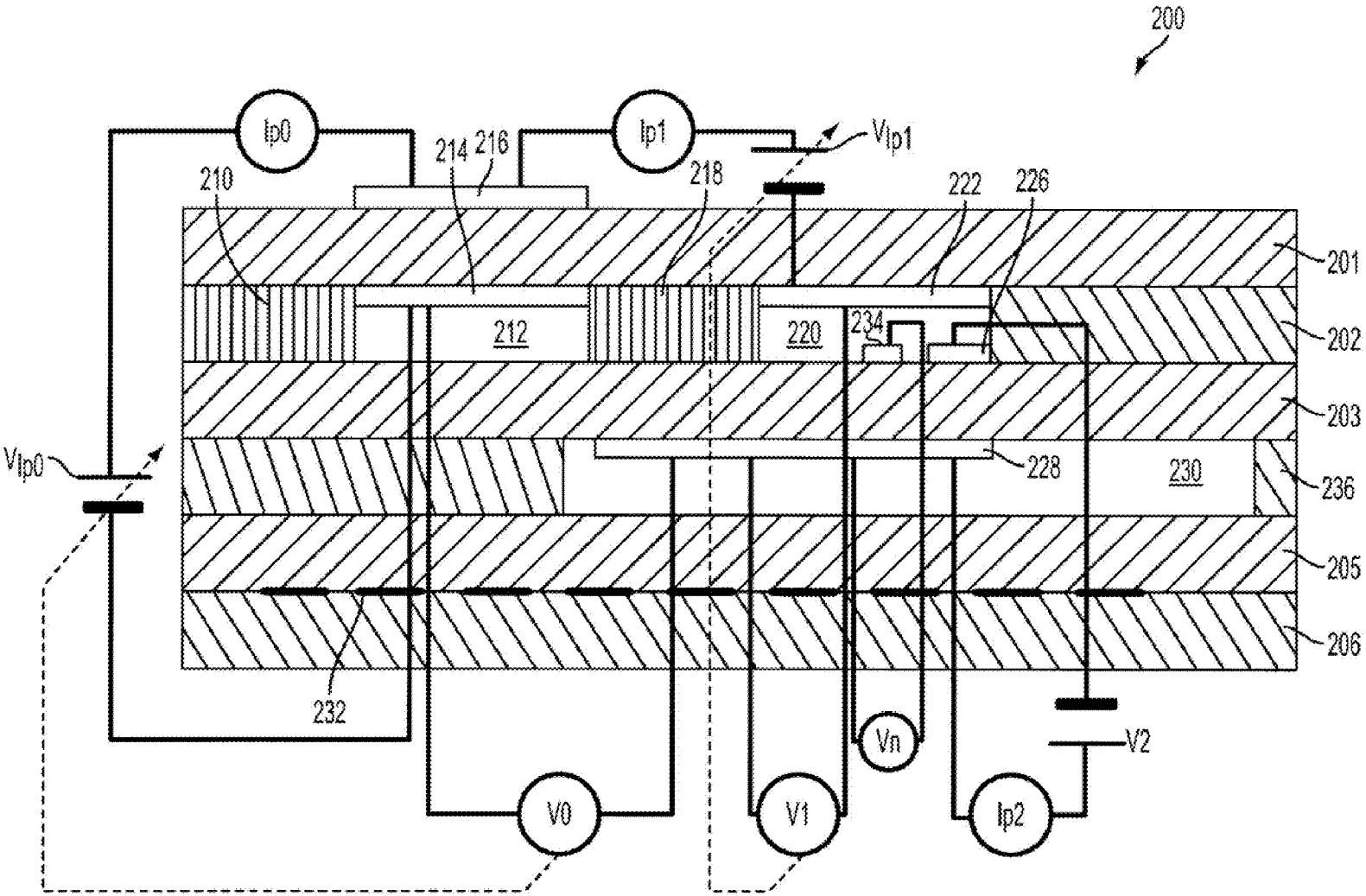
FIG. 2 shows a schematic diagram of an example $NO_x$ sensor.

FIG. 2 shows a schematic view of an example embodiment of a $NO_x$ sensor 200 configured to measure a concentration of $NO_x$ gases in an emissions stream. Sensor 200 may operate as the $NO_x$ sensor 90, 92, or 94 of FIG. 1, for example. Sensor 200 comprises a plurality of layers of one or more ceramic materials arranged in a stacked configuration. In the embodiment of FIG. 2, six ceramic layers are depicted as layers 201, 202, 203, 204, 205, and 206. These layers include one or more layers of a solid electrolyte capable of conducting ionic oxygen and one or more layers of a dielectric not capable of conducting oxygen ions or electrons. Examples of suitable solid electrolytes include, but are not limited to, zirconium oxide-based materials. Further, in some embodiments, a heater 232 may be disposed between the various layers (or otherwise in thermal communication with the layers) to increase the ionic conductivity of the solid electrolyte layers. While the depicted $NO_x$ sensor is formed from six ceramic layers, it will be appreciated that the $NO_x$ sensor may include any other suitable number of ceramic layers.

Layer 202 includes a porous material or materials creating a first diffusion path 210. First diffusion path 210 is configured to introduce exhaust gases into a first internal cavity 212 via diffusion. A first pair of pumping electrodes 214 and 216 is disposed in communication with internal cavity 212, and is configured to electrochemically pump a selected exhaust gas constituent from internal cavity 212 through layer 201 and out of sensor 200. Generally, the species pumped from internal cavity 212 out of sensor 200 may be a species that may interfere with the measurement of a desired analyte. For example, molecular oxygen (e.g., $O_2$) can potentially interfere with the measurement of $NO_x$ in a $NO_x$ sensor, as oxygen is dissociated and pumped at a lower potential than NOx. Therefore, first pumping electrodes 214 and 216 may be used to remove molecular oxygen from within internal cavity 212 to decrease the concentration of oxygen within the sensor relative to a concentration of $NO_x$ within the sensor.

First diffusion path 210 may be configured to allow one or more components of exhaust gases, including but not limited to the analyte and interfering component, to diffuse into internal cavity 212 at a more limiting rate than the interfering component can be electrochemically pumped out by first pumping electrodes pair 214 and 216. In this manner, almost all of oxygen may be removed from first internal cavity 212 to reduce interfering effects caused by oxygen. Herein, the first pumping electrodes pair 214 and 216 may be referred to as an $O_2$ pumping cell.

The process of electrochemically pumping the oxygen out of first internal cavity 212 includes applying an electric potential $V_{Ip0}$ across first pumping electrode pair 214, 216 that is sufficient to dissociate molecular oxygen, but not sufficient to dissociate $NO_x$. With the selection of a material having a suitably low rate of oxygen diffusion for first diffusion path 210, the ionic current $I_{p0}$ between first pumping electrode pair 214, 216 may be limited by the rate at which the gas can diffuse into the chamber, which is proportional to the concentration of oxygen in the exhaust gas, rather than by the pumping rate of the $O_2$ pumping cell. This may allow a substantial majority of oxygen to be pumped from first internal cavity 212 while leaving $NO_x$ gases in first internal cavity 212. A voltage $V_0$ across first pumping electrode 214 and reference electrode 228 may be monitored to provide feedback control for the application of the electric potential $V_{Ip0}$ across first pumping electrode pair 214, 216.

Sensor 200 further includes a second internal cavity 220 separated from the first internal cavity by a second diffusion path 218. Second diffusion path 218 is configured to allow exhaust gases to diffuse from first internal cavity 212 into second internal cavity 220. A second pumping electrode 222 optionally may be provided in communication with second internal cavity 220. Second pumping electrode 222 may, in conjunction with electrode 216, be set at an appropriate potential $V_{Ip1}$ to remove additional residual oxygen from second internal cavity 220. Second pumping electrode 222 and electrode 216 may be referred to herein as a second pumping electrode pair or a residual $O_2$ monitoring cell. Alternatively, second pumping electrode 222 may be configured to maintain a substantially constant concentration of oxygen within second internal cavity 220. In some embodiments, ($V_{Ip0}$) may be approximately equal to ($V_{Ip1}$) while in other embodiments ($V_{Ip0}$) and ($V_{Ip1}$) may be different. While the depicted embodiment utilizes electrode 216 to pump oxygen from first internal cavity 212 and from second internal cavity 220, it will be appreciated that a separate electrode (not shown) may be used in conjunction with electrode 222 to form an alternate pumping electrode pair to pump oxygen from second internal cavity 220. A voltage $V_1$ across second pumping electrode 222 and reference electrode 228 may be monitored to provide feedback control for the application of the electric potential $V_{Ip1}$ across second pumping electrode pair 222, 216.

First pumping electrode 214 and second pumping electrode 222 may be made of various suitable materials. In some embodiments, first pumping electrode 214 and second pumping electrode 222 may be at least partially made of a material that catalyzes the dissociation of molecular oxygen to the substantial exclusion of $NO_x$. Examples of such materials include, but are not limited to, electrodes containing platinum and/or gold.

Sensor 200 further includes a measuring electrode 226 and a reference electrode 228. Measuring electrode 226 and reference electrode 228 may be referred to herein as a measuring electrode pair. Reference electrode 228 is disposed at least partially within or otherwise exposed to a reference duct 230. In one embodiment, reference duct 230 may be open to the atmosphere and may be referred to as a reference air duct. In another embodiment, reference duct 230 may be isolated by a layer 236 from the atmosphere such that oxygen pumped from second internal cavity 220 may be accumulated within the duct, thus reference duct 230 may be referred to as an oxygen duct.

Measuring electrode 226 may be set at a sufficient potential relative to reference electrode 228 to pump $NO_x$ out of second internal cavity 220. Further, measuring electrode 226 may be at least partially made of a material that catalyzes dissociation or reduction of any $NO_x$. For example, measuring electrode 226 may be made at least partially from platinum and/or rhodium. As $NO_x$ is reduced to $N_2$, the oxygen ions generated are electrochemically pumped from second internal cavity 220. The sensor output is based upon the pumping current flowing through measuring electrode 226 and reference electrode 228, which is proportional to the concentration of $NO_x$ in second internal cavity 220. Thus, the pair of electrodes 226 and 228 may be referred to herein as a $NO_x$ pumping cell.

Sensor 200 further includes a calibration electrode 234. Calibration electrode 234 is used to measure the residual oxygen concentration in second internal cavity 220 according to a Nernst voltage ($V_n$) with reference to reference electrode 228. Thus, calibration electrode 234 and reference electrode 228 may be referred to herein as a calibration electrode pair or as a residual $O_2$ monitoring cell. As shown in FIG. 2, calibration electrode 234 is disposed on the same solid electrolyte layer 203 as measuring electrode 226. Typically, calibration electrode 234 is disposed spatially adjacent to measuring electrode 226. The term "spatially adjacent" as used herein refers to the calibration electrode 234 being in the same volume of space (for example, second internal cavity 220) as measuring electrode 226. Furthermore, placing the calibration electrode 234 in close proximity to measuring electrode 226 may reduce the magnitude of any differences in oxygen concentration at the measuring electrode and at the calibration electrode due to an oxygen concentration gradient between the two electrodes. This may allow residual oxygen concentrations to be measured more accurately. Alternatively, calibration electrode 234 and measuring electrode 226 may be disposed on different solid electrolyte layers. For example, calibration electrode 234 may be disposed on solid electrolyte layer 201 instead of layer 203.

It will be appreciated that the depicted calibration electrode locations and configurations are merely exemplary, and that calibration electrode 234 may have various suitable locations and configurations that allows a measurement of residual oxygen to be obtained. Further, while the depicted embodiment utilizes electrode 228 as a reference electrode of the calibration electrode pair, it will be appreciated that a separate electrode (not shown) may be used in conjunction with calibration electrode 234 to form an alternative calibration electrode pair configuration.

It should be appreciated that the $NO_x$ sensors described herein are merely example embodiments of $NO_x$ sensors, and that other embodiments of $NO_x$ sensors may have additional and/or alternative features and/or designs. For example, in some embodiments, a $NO_x$ sensor may include only one diffusion path and one internal cavity, thereby placing the first pumping electrode and measuring electrode in the same internal cavity. In such an embodiment, a calibration electrode may be disposed adjacent to the measuring electrode so that the residual oxygen concentration of an exhaust gas at or near the measuring electrode can be determined with a minimized impact from any oxygen concentration gradient.

The $NO_x$ sensor is calibrated, and thus may give accurate $NO_x$ concentration readings, when the temperature of the $NO_x$ sensor is at the set-point temperature (e.g., activation temperature). When the $NO_x$ sensor has a heater, the heater and a feedback control system may be used to maintain the $NO_x$ sensor at its activation temperature. However, transient engine conditions may cause the temperature the $NO_x$ sensor to be perturbed from its activation temperature. For example, the temperature of the $NO_x$ sensor may be lowered when a large increase of exhaust gas flows through the sensor, and the sensor heater is unable to maintain the temperature of the NOx sensor at a target value. As another example, the temperature of the exhaust gas may transiently increase or decrease causing a corresponding temporary rise or fall in the temperature of the $NO_x$ sensor temperature. While a variance from the activation temperature will yield an erroneous NOx concentration reading, the reading may be corrected if the temperature of the $NO_x$ sensor can be determined, or estimated accurately based on engine operating conditions as described herein.

One method in which the temperature of the $NO_x$ sensor may be identified is by measuring the internal resistances of the $O_2$ pumping cell, the $NO_x$ pumping cell, and the residual $O_2$ monitoring cell. The internal resistance of a cell is dependent on the temperature of the cell, thus, the internal resistance of the cell changes with a change in temperature. For example, as the temperature increases, the internal resistance decreases.

There are a variety of methods for detecting the internal resistance of a set of electrodes. The following examples will be described with reference to the $O_2$ pumping cell; however, the methods may apply to any of the aforementioned cells. One method for determining the internal resistance of the $O_2$ pumping cell is to apply a constant current through electrodes 214 and 216 for an amount of time ranging from one tenth of a microsecond to tens of seconds. As the constant current is applied, the voltage across electrodes 214 and 216 may be measured such that the resistance may be calculated from Ohm's law. A second method for determining the internal resistance of the $O_2$ pumping cell is by applying a constant voltage across electrodes 214 and 216 for an amount of time ranging from one tenth of a microsecond to tens of seconds. As the constant voltage is applied, the current through electrodes 214 and 216 may be measured such that the resistance may be calculated from Ohm's law.

One disadvantage with measuring the resistance, and thus the temperature, of the $NO_x$ sensor using the aforementioned methods is that the $NO_x$ concentration may not be measured concurrently with the temperature measurement. In other words, while the resistance measurement is being made, the $NO_x$ concentration cannot be measured. However, this limitation may be overcome by monitoring the parameters that cause the $NO_x$ sensor temperature to fluctuate and then correcting the $NO_x$ concentration reading based on those parameters rather than, or in addition to, a direct measurement of the resistance between the electrodes in the $NO_x$ sensor.

Figure 3:
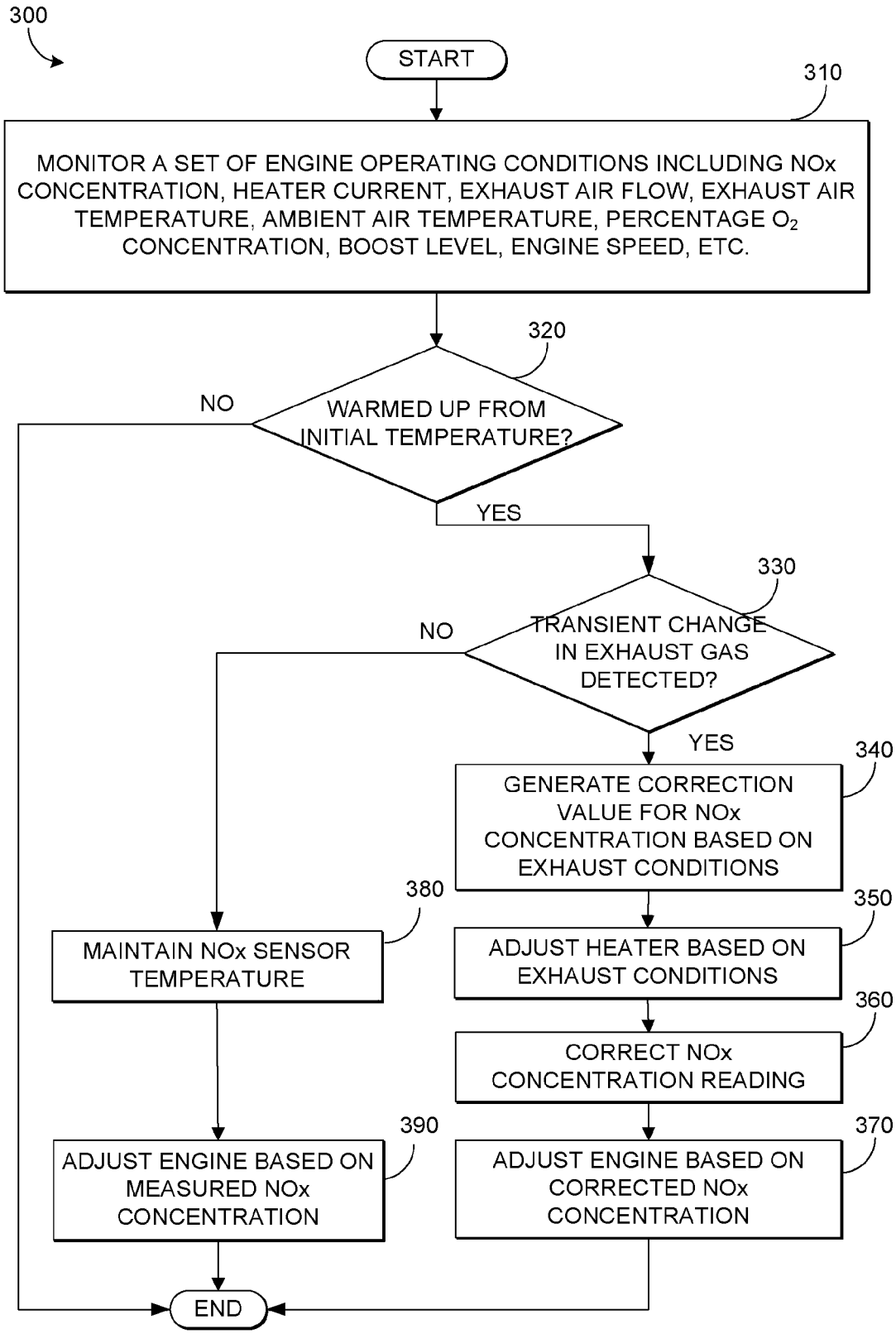
FIG. 3 shows a flow chart illustrating a routine that adjusts an engine based on engine operating conditions including $NO_x$ concentration readings from a $NO_x$ sensor.

FIG. 3 describes routine 300 that may be used to adjust an engine during a variety of engine operating conditions. For example, the engine may be adjusted based on a measured $NO_x$ concentration level when the engine conditions are in steady-state, and the engine may be adjusted based on a corrected $NO_x$ concentration when the engine conditions are transient in nature. Routine 300 begins at 310, where a set of engine operating conditions may be monitored and recorded. Some of the engine operating conditions may be used for further calculations. The $NO_x$ concentration output from the $NO_x$ sensor may be monitored. As discussed previously, the $NO_x$ concentration output may be accurate if the temperature of the $NO_x$ sensor is at the activation temperature but, the $NO_x$ concentration output may be in need of correction if the temperature of the $NO_x$ sensor differs from the activation temperature. The current applied to the $NO_x$ sensor heater may be directly measured or it may be calculated from a heater control system. The exhaust air flow may be measured by a mass air flow sensor placed somewhere in the path of the exhaust such as sensor 90 or 94 or it may be inferred from many sensors. The exhaust air temperature may be measured by a temperature sensor such as sensor 90 or 94 or it may be inferred from many sensors. Other engine conditions that may be of interest include: ambient air temperature, percentage of $O_2$ concentration in the exhaust gases, engine boost level, engine speed, wall clock time (e.g. the amount of time that has elapsed from the commencement of the exhaust gas flow transient), etc. It will be appreciated that the engine operating conditions disclosed herein are exemplary in nature, and that these specific engine operating conditions are not to be considered in a limiting sense, because numerous variations are possible. Routine 300 proceeds to 320 from 310.

At 320, it is determined if the $NO_x$ sensor has warmed up to the activation temperature. If the $NO_x$ sensor is still warming up, then the routine will end. The $NO_x$ sensor temperature may be measured as previously described. If the $NO_x$ sensor has warmed up, then the routine may proceed to 330.

At 330, the engine conditions are examined for a transient change in exhaust conditions. As an example, the exhaust air flow may be monitored as a function of time and the rate of change of exhaust gas flow may be calculated. If the rate of change of exhaust gas flow exceeds a threshold value then the engine may be defined as in a transient condition. As another example, the exhaust temperature may be monitored as a function of time and the rate of change of exhaust temperature may be calculated. If the rate of change of exhaust temperature exceeds a threshold value then the engine may be defined as in a transient condition. Further still, the routine may monitor the rate of change of excess oxygen in the exhaust. Moreover, each of the above transient conditions may be used in combination. Thus, various engine conditions and combinations of engine conditions may be monitored in such a way to determine transient conditions. If a transient exhaust gas condition is detected, the routine proceeds to 340. If a transient exhaust gas condition is not detected, the engine is in steady state operation and the routine proceeds to 380.

At 380, the heater is controlled such that the temperature of the $NO_x$ sensor may be maintained, at least nominally, at the activation temperature. As one example, a proportional-integral-derivative (PID) controller may be used in a feedback control loop to control the heater current such that temperature of the $NO_x$ sensor can be stably maintained at the activation temperature. Using a low gain may make the control loop more stable during steady-state operation, but it may reduce the ability of the control loop to change the heater current rapidly enough to maintain the $NO_x$ sensor temperature when engine conditions experience a sufficiently transient condition. Other examples of control methods that may be used to maintain the $NO_x$ sensor temperature are expert systems, fuzzy logic, neural networks, etc. The routine progresses to 390 from 380.

At 390, the engine may be adjusted based on the measured $NO_x$ concentration. For example, the engine control system may inject a controlled amount of urea into the exhaust gases so that urea may react with $NO_x$ to create nitrogen and oxygen in the catalytic converter. As another example, the LNT regeneration cycle may be triggered to start. As another example, the on-board diagnostics may record an event if the $NO_x$ concentration exceeds a threshold value. The routine ends after 390.

If a transient engine condition was detected at 330, the routine will continue at 340. At 340, a correction value for the $NO_x$ concentration reading may be generated based on the rate of change of exhaust gas flow and the time since a step change in exhaust gas flow. A relationship between $NO_x$ sensor temperature and the correction value to the $NO_x$ concentration may be determined. However, the rate of change of exhaust gas flow (e.g., time rate of change in one example) may be used to determine, or may be correlated to, the transient temperature of the $NO_x$ sensor and thus, the correction value to the $NO_x$ concentration may be directly determined by the rate of change of exhaust gas flow without having to measure the temperature of the $NO_x$ sensor (although temperature measurement may be used in addition to such an approach, if desired).

In an example embodiment, the correction value may be generated by reading the correction value from a look-up table that is indexed by the time rate of change of exhaust gas flow rate, excess oxygen, temperature, time since a step change in exhaust gas flow, and/or combinations thereof. In an alternate embodiment, the correction value may be generated by a set of calculations that use the time rate of change of exhaust gas flow rate as an input. In yet another embodiment, the correction value may be generated by a combination of table look-ups and calculations. For example, the output from a set of calculations using Newton's law of cooling or Fourier's Law in conjunction with the activation temperature, the exhaust flow volume, and the exhaust flow temperature may be used as input to a function describing the relationship between $NO_x$ sensor temperature and the correction value. These calculations may be performed in real-time by the engine control system, or, the calculations may be performed during the design phase of the control system and the results may be loaded into a look-up table. As another example, experimental data may be used to populate a look-up table.

It should be appreciated that the amount of correction based on exhaust gas flow changes, for example, may be tailored to errors in the NOx reading, and may be particular to the type of temperature correction used, if any. For example, temperature corrections may be additionally applied to the NOx sensor readings to partially address transient temperature-generated errors, however, such corrections may still be insufficient. Nevertheless, the correction based on exhaust gas flow rate changes, for example, may be determined after identifying any remaining error in the NOx reading after temperature corrections are applied. Further, if the temperature corrections are removed, for example, alternative corrections based on the change in exhaust gas flow rate may be used.

At 350, the heater for the $NO_x$ sensor may be adjusted based on the rate of change of exhaust gas flow. As one example, the feedback term for the PID controller may be supplied by a calculation based on the rate of change of exhaust gas flow rather than a measurement of the $NO_x$ sensor temperature. As another example, the gain of the PID controller may be temporarily increased such that the temperature of the $NO_x$ sensor may converge faster on the activation temperature after it has been perturbed by transient engine conditions.

At 360, an erroneous output from the $NO_x$ sensor may be corrected using the correction value that was generated and stored at 340 to create a corrected $NO_x$ concentration. The corrected $NO_x$ concentration may then be used to adjust the engine at 370. The adjustments may include injecting urea, updating on-board diagnostics, etc. The routine ends after 370.

Thus, by the actions described above, it is possible to continuously monitor the $NO_x$ concentration during transient engine conditions, while providing appropriate temperature corrections. Specifically, in one example, the actions include generating a correction value for a $NO_x$ concentration reading from the $NO_x$ sensor based on the rate of change of exhaust gas flow and correcting the $NO_x$ concentration reading using the correction value. Such operation enables the correction to the NOx concentration to be determined and utilized even before any sensing of the NOx temperature identifies that the NOx sensor has deviated from its target temperature, which typically occurs after erroneous NOx sensor readings have already been taken and relied upon. Thus, the rate of change of exhaust gas flow, for example, enables accurate readings of the NOx sensor even before the system could even detect that the NOx sensor was generating potentially degraded readings.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be encoded as microprocessor instructions and stored into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. As still another example, the approaches described herein may be applied to other temperature controlled exhaust sensors, such an ammonia sensor or the like. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method of controlling an engine of a vehicle during engine operation, the engine having an exhaust, and a $NO_x$ sensor including a heater coupled in the engine exhaust, comprising:

adjusting an operating parameter in response to an adjusted NOx sensor output, where the adjustment of the NOx sensor output is based on a transient engine exhaust condition and corrects the NOx sensor output during the transient condition, the adjustment of the output of the NOx sensor including:

generating a correction value for a $NO_x$ concentration reading from the $NO_x$ sensor based on a rate of change of exhaust gas flow rate; correcting the $NO_x$ concentration reading using the correction value; and adjusting the heater of the $NO_x$ sensor during the transient condition.

2. The method of claim 1 wherein the operating parameter is a fuel injection amount, and the transient condition includes the rate of change of exhaust gas flow rate.

3. The method of claim 1 wherein the transient condition includes a time rate of change of exhaust gas flow rate, the adjustment of the NOx sensor output correcting for a transient, and temporary, temperature change of the NOx sensor.

4. The method of claim 1 wherein generating the correction value includes calculating the correction value in real-time by an engine control system.

5. The method of claim 1 wherein generating the correction value includes reading the correction value from a look-up table that is indexed by rate of change of exhaust gas flow rate.

6. The method of claim 1 wherein the transient condition includes a change in $O_2$ concentration in exhaust gas.

7. The method of claim 1, wherein a correction value for the NOx concentration reading from the NOx sensor is directly determined by the rate of change of exhaust gas flow rate without measuring a temperature of the NOx sensor.

8. The method of claim 1, wherein the correction value is generated after identifying a remaining error in the NOx concentration reading after temperature corrections are applied.

9. A system, comprising:

an engine exhaust;

a $NO_x$ sensor coupled in the engine exhaust, the $NO_x$ sensor having a heater; and a control system including a computer readable storage medium, the medium including instructions thereon, the control system receiving communication from the $NO_x$ sensor, the medium comprising:

instructions for, after the $NO_x$ sensor has warmed up to an activation temperature, generating a correction value for a $NO_x$ concentration reading from the $NO_x$ sensor based on transient exhaust gas conditions, correcting the $NO_x$ concentration reading with the correction value to create a corrected $NO_x$ concentration, and adjusting the engine based on the corrected $NO_x$ concentration while the exhaust gas conditions are transient, the correction value generated before any sensing of NOx sensor temperature identifies that the NOx sensor has deviated from a target temperature.

10. The system of claim 9 wherein the transient exhaust gas conditions include when a rate of change of exhaust air flow rate is greater than a threshold.

11. The system of claim 10 wherein the transient exhaust gas conditions include when a rate of change of exhaust air temperature is greater than a threshold.

12. The system of claim 10 wherein the transient exhaust gas conditions include when a rate of change of heater current is greater than a threshold.

13. The system of claim 10 wherein generating the correction value includes calculating the correction value in real-time by an engine control system.

14. A method of controlling an engine during engine operation, the engine having an exhaust, and a $NO_x$ sensor including a heater coupled in the exhaust, comprising:

continuously monitoring NOx concentration during transient conditions; and generating a correction value for a $NO_x$ concentration reading from the $NO_x$ sensor based on a time rate of change of exhaust gas flow rate when adjustment of the heater is unable to maintain NOx sensor temperature at a desired temperature.

15. The method of claim 14 further comprising correcting the NOx concentration reading using the correction value.

16. The method of claim 15 further comprising adjusting the heater of the NOx sensor during transient conditions.

17. The method of claim 16 wherein the correction value is further based on one or more of a rate of change of exhaust temperature, a rate of change of heater current, and a rate of change of a percentage of excess $O_2$ concentration in the exhaust.

* * * * *